US006736399B1

(12) United States Patent
Copenhaver

(10) Patent No.: US 6,736,399 B1
(45) Date of Patent: May 18, 2004

(54) MECHANICAL ROPING STEER APPARATUS WITH ENHANCED STRIDE SIMULATION

(76) Inventor: Alan R. Copenhaver, 29724 Heron Ave., Hinton, IA (US) 51024

( * ) Notice: Subject to any disclaimer, the term of this patent is extended or adjusted under 35 U.S.C. 154(b) by 0 days.

(21) Appl. No.: 10/099,167

(22) Filed: Mar. 15, 2002

(51) Int. Cl.[7] ..... A63B 67/06; A63B 67/00; A01K 15/02

(52) U.S. Cl. ..... 273/339; 273/359; 119/839

(58) Field of Search ..... 273/339, 336–338, 273/359, 367, 370, 348; 119/839; 434/247, 219

(56) References Cited

U.S. PATENT DOCUMENTS 4,266,779 A * 5/1981 English ..... 119/839

4,451,045 A * 5/1984 Fesmire ..... 273/338

* cited by examiner

*Primary Examiner*—Gregory Vidovich
*Assistant Examiner*—Mitra Aryanpour
(74) *Attorney, Agent, or Firm*—Leonard & Proehl Prof. LLC

(57) ABSTRACT

A mechanical roping steer apparatus with enhanced stride simulation includes a forward support assembly for resting on a ground surface. The support assembly has a front and a rear. A rearward steer assembly is located rearwardly of the support assembly and is mounted on the rear of the support assembly. The steer assembly comprises a leg assembly including a pair of leg members being pivotable with respect to the ground surface and an actuation mechanism for pivoting the leg members when the support assembly is moved across the ground surface.

14 Claims, 7 Drawing Sheets

MECHANICAL ROPING STEER APPARATUS WITH ENHANCED STRIDE SIMULATION

BACKGROUND OF THE INVENTION

1. Field of the Invention

The present invention relates to steer roping practice apparatus and more particularly pertains to a new mechanical roping steer apparatus with enhanced stride simulation for providing a highly realistic reproduction of the structure and movement of the hind legs of a steer to enable highly effective roping practice without using a live steer.

2. Description of the Prior Art

Team steer roping events of rodeos involve coordinated horse riding and steer roping by two persons who participate as a team. In this rodeo event, a steer is released from a confinement pen and runs out into the rodeo arena. One team member, known as the "header", rides a horse to the left of and slightly behind the steer, and the other team member, known as the "heeler", rides a horse to the right of and also slightly behind the running steer. As the steer runs, the header team member first ropes, or lassos, the horns of the steer and secures the end of the rope to the horn of the saddle of the header's horse, and turns his or her horse to the left to cause the steer to also turn to the left and then pull the steer in the leftward direction. Once the steer has taken at least one stride after the turn, the heeler team member attempts to rope or lasso the hind legs of the steer so that the steer may be held by the ropes of the header and heeler. Since the team steer roping event is timed, the more quickly these steps can be executed, the more successful the team is likely to be in rodeo competition. Thus, practice of the header and heeler duties by the team members is highly desirable to prepare a team for actual competition. The movement of the steer's hind legs makes the heeler's duties more challenging than the header's duties, and thus the heeler team member can be helped by practice, especially with conditions that are as close as possible to actual competition.

The existence and use of steer roping practice apparatus is known in the prior art. Generally, the use of some type of mechanical practice apparatus is highly desirable, as this avoids the need to gain regular access to a steer to practice on. Mechanical practice apparatus can also provide relatively more practice during a given time period, since a live steer needs to be captured after each run. Further, a mechanical apparatus does not tire after several runs as might a live steer.

Many of the known mechanical practice apparatus employ some structure that simulates the moving hind legs of a steer in an attempt to make the roping practice as realistic and challenging as possible. However, it is believed that the known apparatus have been lacking in sufficient realism of structure and movement that would produce the most valuable practice.

One drawback of some of the known apparatus is that the size of the apparatus has been too large, and the user is thus forced to practice roping horns or legs that are not positioned at a realistic height with respect to the ground, and with respect to the user riding on a horse.

Another drawback has been that while a live steer's legs spend a significant portion of the stride on the surface of the ground, many if not all of the known apparatus employ leg structures that do not contact the ground devices during any portion of the stride. Since a proper roping of the hind legs of the steer typically involves the precise placement of the loop of rope on the ground forward of the hind legs so that the hind legs step into the loop and thus snag the loop, success at roping the legs of the known practice apparatus' does not necessarily translate to success on live steers because techniques that work on the elevated hind legs of the practice apparatus may not work on the hind legs of the steer which will contact the ground.

Yet another drawback of at least some of the known apparatus' is the inaccuracy of the length and speed of the stride of the legs of the apparatus, since the heeler's throw should be timed to the stride of the steer for the greatest likelihood of success, and thus the ability of the heeler to practice on an apparatus having a realistic stride is highly desirable and important.

In these respects, the mechanical roping steer apparatus with enhanced stride simulation according to the present invention substantially departs from the conventional concepts and designs of the prior art, and in so doing provides an apparatus primarily developed for the purpose of providing a highly realistic reproduction of the structure and movement of the hind legs of a steer to enable highly effective roping practice without using a live steer.

SUMMARY OF THE INVENTION

In view of the foregoing disadvantages inherent in the known types of steer roping practice apparatus now present in the prior art, the present invention provides a new mechanical roping steer apparatus with enhanced stride simulation construction wherein the same can be utilized for providing a highly realistic reproduction of the structure and movement of the hind legs of a steer to enable highly effective roping practice without using a live steer.

To attain this, the present invention generally comprises a forward support assembly for resting on a ground surface. The support assembly has a front and a rear. A rearward steer assembly is located rearwardly of the support assembly and is mounted on the rear of the support assembly. The steer assembly comprises a leg assembly including a pair of leg members being pivotable with respect to the ground surface and an actuation mechanism for pivoting the leg members when the support assembly is moved across the ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
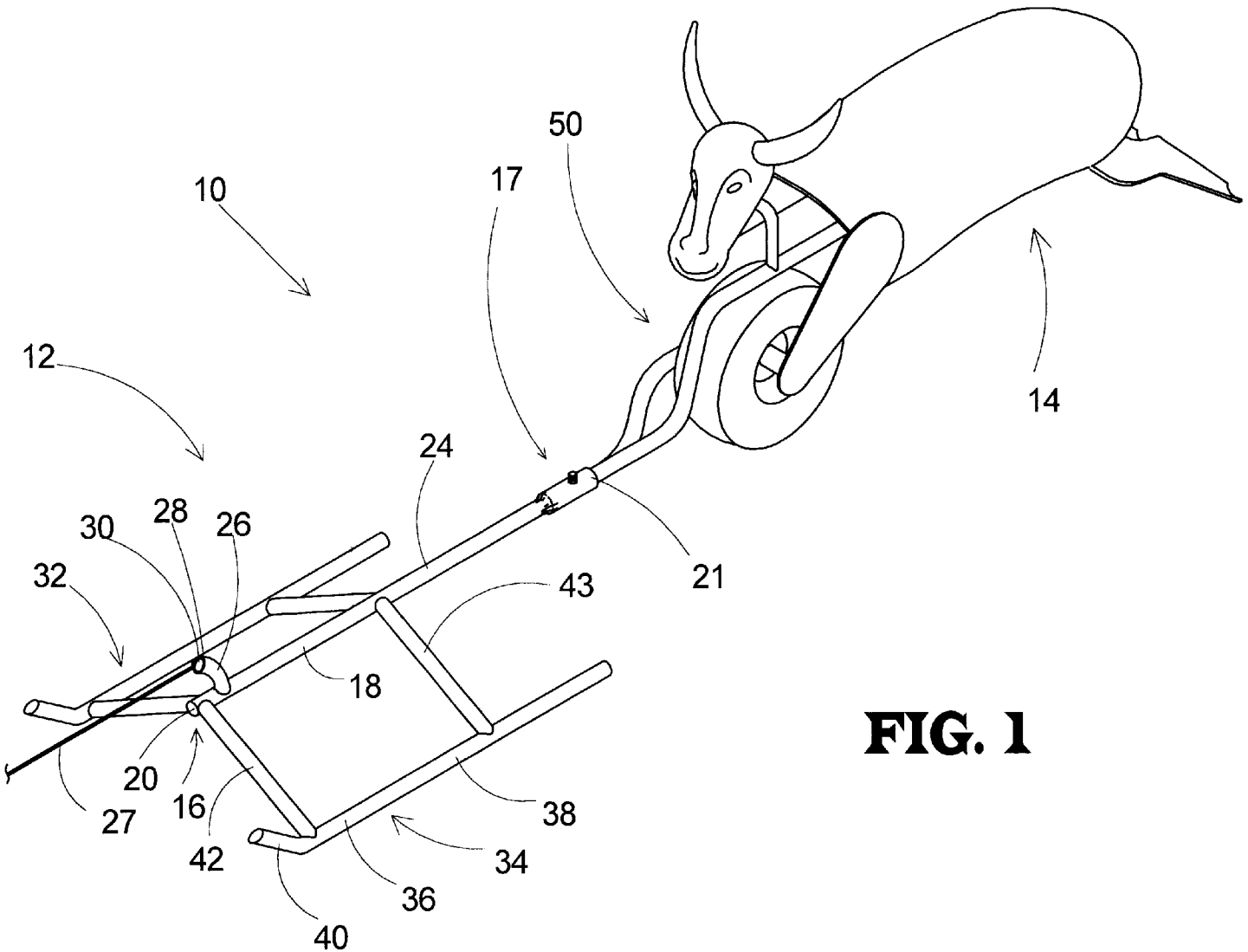
FIG. 1 is a schematic perspective view of a new mechanical roping steer apparatus according to the present invention and particularly illustrating the support assembly and steer assembly.
Figure 2:
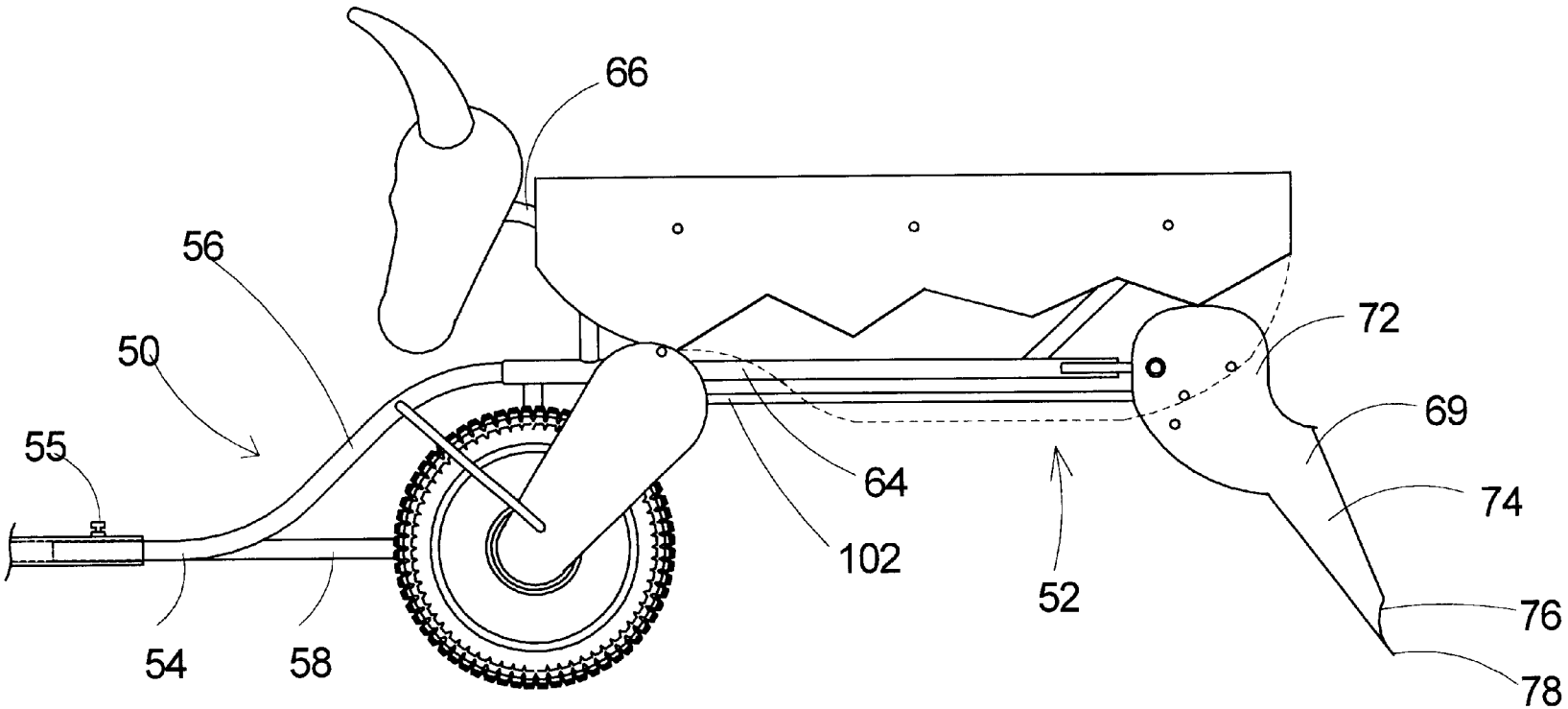
FIG. 2 is a schematic side view of the steer assembly of the present invention.
Figure 3:
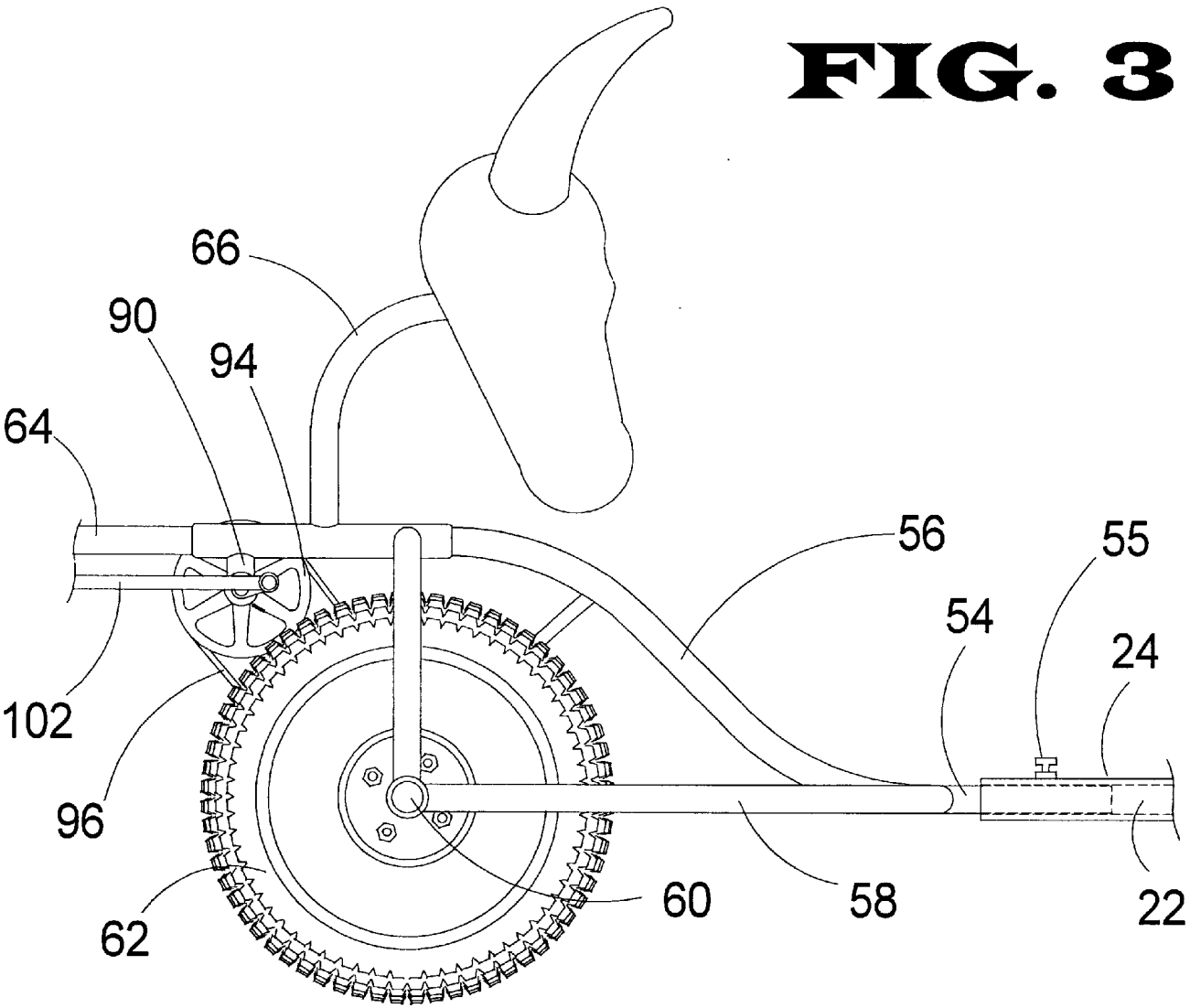
FIG. 3 is a schematic side view of the steer assembly of the present invention with portions of the body cladding removed to reveal detail.
Figure 4:
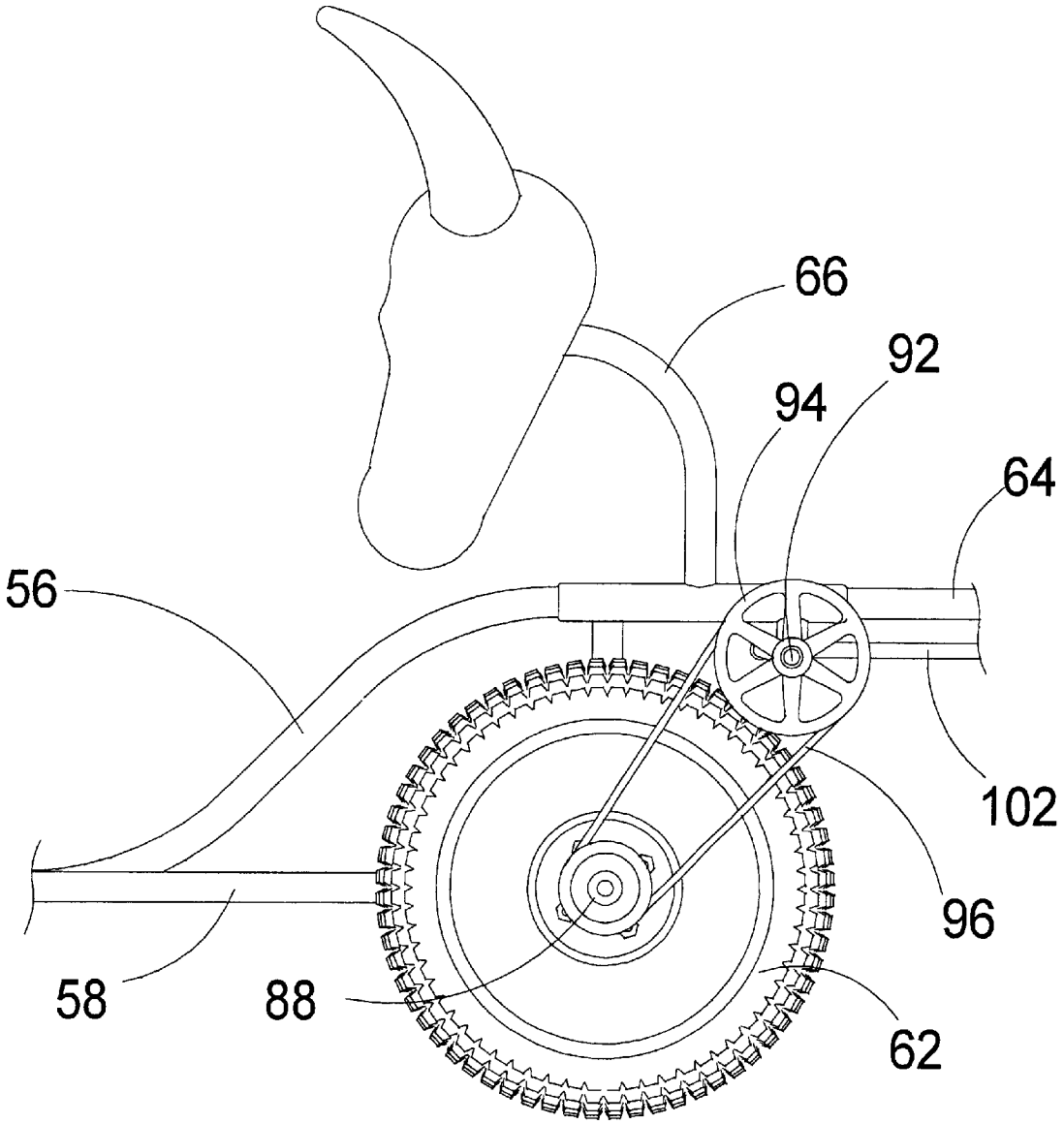
FIG. 4 is a schematic side view of the present invention taken from the opposite side of the steer assembly with portions of the body cladding removed to reveal detail.
Figure 5:
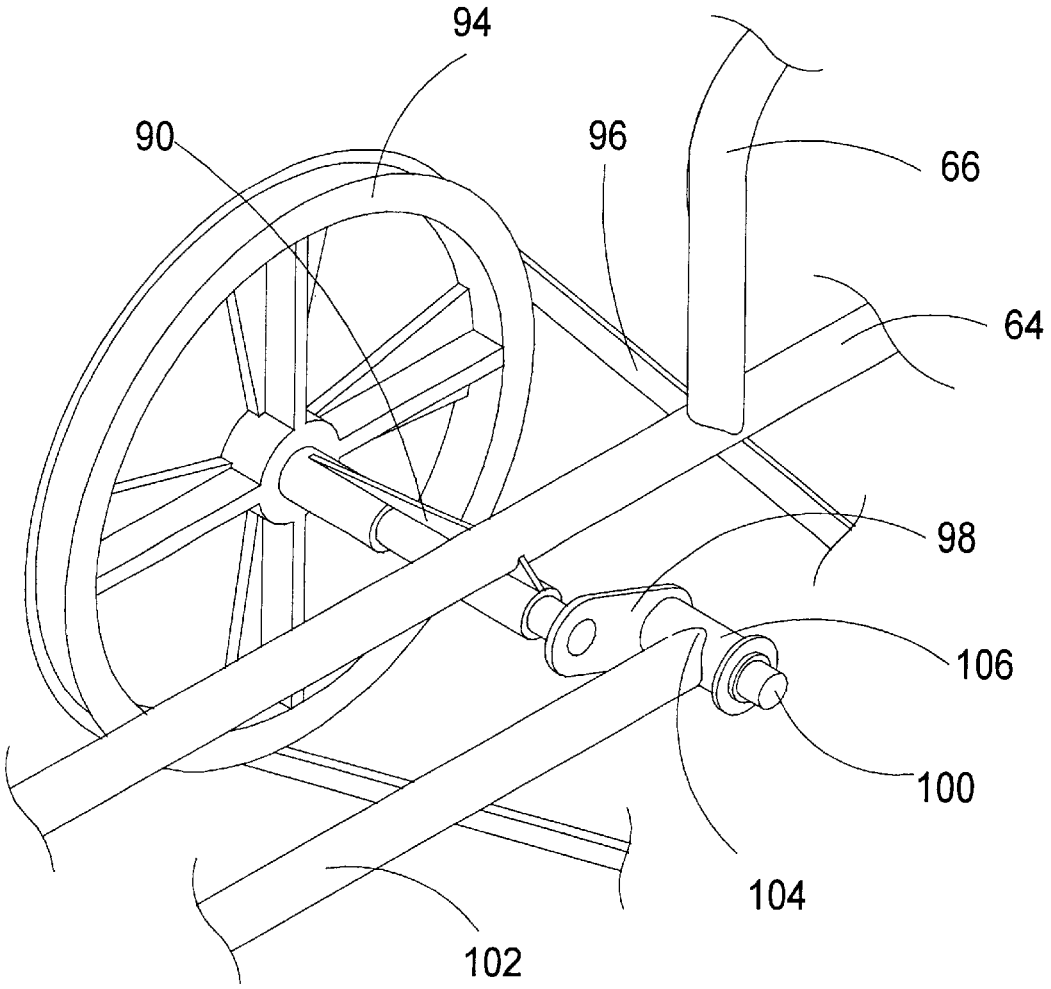
FIG. 5 is a schematic partial perspective view of a forward portion of the steer assembly of the present invention with portions of the body cladding removed to reveal detail.
Figure 6:
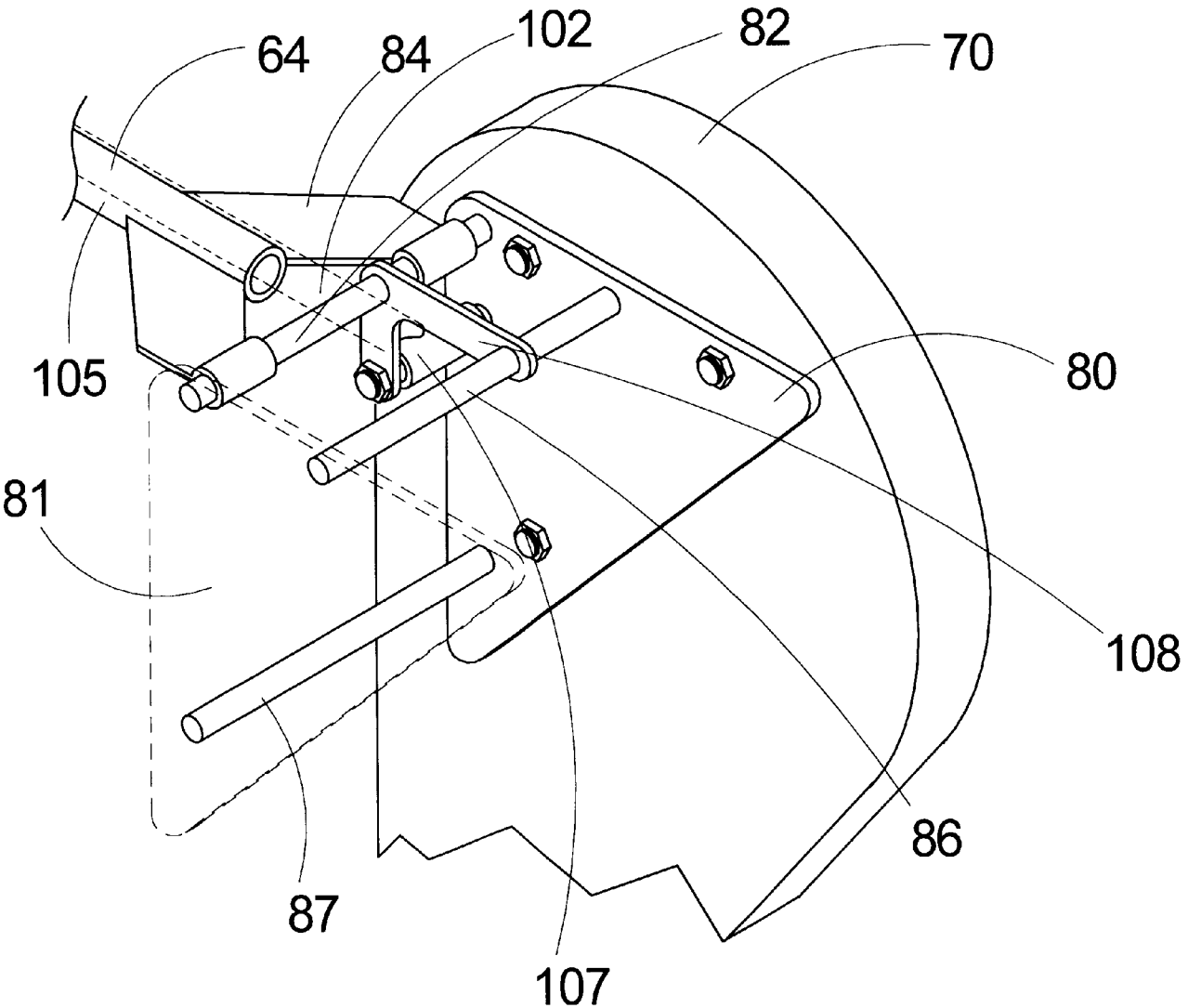
FIG. 6 is a schematic rear perspective view of a portion of the leg assembly of the present invention.
Figure 7:
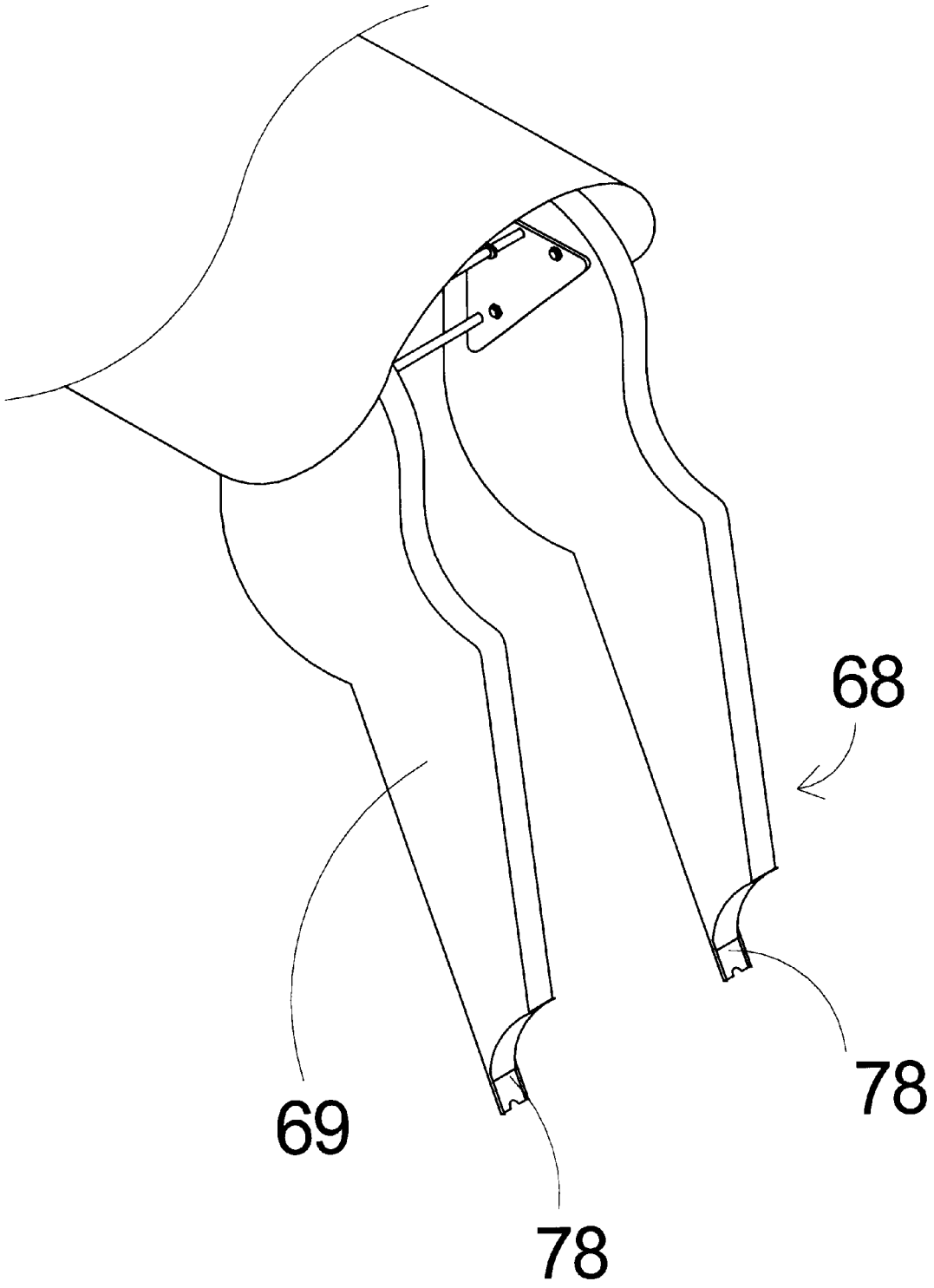
FIG. 7 is a schematic rear perspective view of the present invention showing the leg assembly.

With reference now to the drawings, and in particular to FIGS. 1 through 7 thereof, a new mechanical roping steer apparatus with enhanced stride simulation embodying the principles and concepts of the present invention and generally designated by the reference numeral 10 will be described.

As best illustrated in FIGS. 1 through 6, the mechanical roping steer apparatus 10 for practicing roping of a steer generally comprises a forward support assembly 12 for resting on a ground surface and a rearward steer assembly 14 simulating a steer with an enhanced stride simulation of rear leg members. The mechanical roping steer apparatus 10 of the invention may be pulled through the forward support assembly 12 by a variety of pulling means, such as a horse and rider and vehicles such as all terrain vehicles or other larger vehicles.

The forward support assembly 12 of the mechanical roping steer apparatus generally has a front 16 and a rear 17. The support assembly 12 may includes a base portion 18 with a forward end 20 and a rearward end 21. The rearward end 21 of the base portion 18 may have a recess 22 formed therein that opens in a rearward direction for a purpose described in greater detail below.

The base portion 18 may include a base member 24 that extends from the forward end 20 to the rearward end 21 of the base portion. The base portion 18 may also include an upright member 26 that is mounted on the base member 24 for attaching to a pull member 27 (such as a flexible member like a rope or cord) attached to a pulling means for pulling the support assembly 12. The upright member 26 may extend upwardly and may extend forwardly from the base member 24. An upper end 28 of the upright member 26 may have a loop 30 formed thereon for attachment to the pull member 27.

The support assembly 12 may also include a pair of lateral skid portions 32, 34 for contacting the ground surface. The lateral skid portions 32, 34 may extend laterally from the base portion 18. Each of the lateral skid portions may comprise a skid member 36 that extends between the front 16 and the rear 17 of the support assembly 12. Each skid member 36 may have a main portion 38 that is substantially linear and a forward portion 40 that extends forwardly and upwardly from the main portion. Each of the lateral skid portions 32, 34 may further include at least one lateral member 42 that extends laterally from the base portion 18 to the skid member 36. The lateral member 42 may extend downwardly from the base portion 18 to the lateral skid portion 32, 34 to raise the base portion to a vertical level above the skid member 36 with respect to the ground surface. Each lateral skid portion 32, 34 may include a pair of the lateral members 42, 43 that extend between the base portion 18 and the skid member 36. Optionally, each of the lateral members 42, 43 may comprise two sections, with a first section being attached to the base member 24 and a second section attached to the lateral skid member 36. The sections of the lateral members may be mounted together in a generally telescopic relationship that permits removal of one section of the lateral member from the section of the lateral member, thus permitting the support assembly to be partially broken down for transport and storage by permitting removal of a portion of the lateral skid portions from the base portion.

The rearward steer assembly 14 of the invention is mounted on the support assembly 12. The steer assembly 14 may include a forward frame portion 50 and a rearward frame portion 52.

The steer assembly 14 may be rotatably mounted on the support assembly 12 such that the steer assembly is rotatable about an axis that extends between the support assembly 12 and the steer assembly 14. The forward frame portion 50 may include a front rotate member 54 that may be rotatably mounted in the recess 22 in the base portion 18 to permit rotation of the front rotate member of the steer assembly with respect to the base portion of the support assembly. A securing structure may be provided for selectively securing a rotational position of the steer assembly 14 with respect to the support assembly 12. In one embodiment of the invention, the securing structure comprises a fastener 55 that is threadedly mounted on the base member 24 of the support assembly 12 for selectively bearing on the front rotate member 54 for releaseably locking a position of the front rotate member with respect to the base member. With this feature, the steer assembly may be selectively tilted with respect to the support assembly and to the ground surface, which can be useful for practicing roping the legs and/or horns of the steer apparatus of the invention.

The forward frame portion 50 may also include a first member 56 that extends generally rearwardly from the rotate front member 54 and the base portion 18, and may include a second member 58 positioned laterally of the first member and being connected to the first member at forward and rearward locations on the first member. The forward frame portion 50 may also include an axle 60 mounted on the second member. A wheel 62 may be rotatably mounted on the forward frame portion, and is mounted on the axle 60. In one preferred embodiment of the invention, the wheel 62 does not provide any significant support to the apparatus as a whole, but merely rotates as the apparatus is moved in a forward direction. The wheel 62 may include a floatation-type tire.

The rearward frame portion 52 may include a spine member 64 extending rearwardly from the forward frame portion 50. The spine member 64 may be positioned relatively higher than the forward frame portion and the wheel. The rearward frame portion 52 may also include a body support member 66 that extends generally upwardly from the spine member 64.

The steer assembly 14 may include a leg assembly 68 that is mounted on the rearward frame portion. The leg assembly 68 may comprise a pair of leg members 69, 70 that are pivotally mounted on the rearward frame portion. Each of the leg members 69, 70 may have an upper portion 72 and a lower portion 74 with a lower end 76. The leg members may be formed of a relatively rigid material that can resist being damaged by repeated ropings of the leg members by a rope during roping practice.

Significantly, the leg assembly 68 may also include a leg extension member 78 that extends from the lower end 76 of the lower portion 74 of the leg member for contacting the ground surface during portions of pivot movement of the leg members. The leg extension members are preferably formed of a resiliently flexible material that can repeatedly contact the ground surface, fold or otherwise deflect, and then recover the original position extending away from the lower end 76. The nature of the leg extension members 78 permits the members 78 to actually contact the ground surface during the pivot movement of the leg members since the relatively more rigid leg members cannot directly contact the ground surface without damaging or wearing away the lower end 76. The leg extension members thus provide a more realistic simulation of a live steer's legs and their contact with the ground, and therefore present the user with a more challenging and realistic roping exercise when attempting to position the loop of rope below the leg extension members.

The leg assembly 68 may also include a mounting structure for pivotally mounting the leg members 69, 70 on the rearward frame portion 52. The mounting structure may include a mounting plate 80, 81 that is mounted on each of the leg members. Each mounting plate 80, 81 may be mounted on the upper portion 72 of one of the leg members 69, 70. The mounting structure may also include a pivot member 82 mounted on the leg members and pivotally mounted on the rearward frame portion. The pivot member 82 may extend between the mounting plates 80, 81 mounted on the leg members 69, 70. The mounting structure may also include a yoke member 84 that is mounted on the spine member 64 of the rearward frame portion 52. The yoke member 84 may have a pair of sleeves with the pivot member 82 extending through the sleeves of the yoke member. The mounting structure may also include one or more linking members 86, 87 that extend between the leg members 69, 70 for coordinating pivot movement of the leg members.

The invention may also include a mechanism for transferring movement of the wheel to the leg assembly. The transferring mechanism may convert the rotational movement of the wheel to pivot movement of the leg assembly with respect to the frame portions. In one embodiment of the invention, the transferring mechanism includes a pulley assembly that comprises a driver pulley 88 mounted on the axle 60 of the forward frame portion 50 such that the driver pulley rotates with the wheel, a pulley axle support 90 mounted on one of the frame portions 50, 52, a pulley axle 92 rotatably mounted on the pulley axle support 90, a driven pulley 94 mounted on one of the frame portions, and a belt 96 rotatably connecting the driver pulley 88 to the driven pulley 94. Optionally, one of the pulleys may have a circumference which is adjustable so that the relative speeds of the driver and driven pulleys may be adjusted. The transferring mechanism may also include a reciprocating assembly for converting the rotational movement of the pulley axle 92 to a generally reciprocating motion. The reciprocating assembly may include an offset plate 98 mounted on the pulley axle for rotating the offset plate upon rotation of the pulley axle, and the offset plate may extend radially outward from a longitudinal axis of the pulley axle. A first stub shaft 100 of the reciprocating assembly may be mounted on the offset plate 98 such that a longitudinal axis of the first stub shaft is offset from the longitudinal axis of the pulley axle. The reciprocating assembly may also include an elongate transfer member 102 that has a first end 104 and a second end 105. The transfer member 102 may include a first end sleeve 106 at the first end 104 of the transfer member, with the first end sleeve being rotatably mounted on the first stub shaft 100, and a second end sleeve 107 at the second end of the transfer member.

The invention may also include an actuating member 108 mounted on the pivot member for movement with the pivot member, and optionally the actuating member may be mounted on one of the linking members. A second stub shaft may be mounted on the actuating member 108, and the second stub shaft may have a longitudinal axis that is spaced or offset from a longitudinal axis of the pivot member. The second end sleeve 107 of the transfer member 102 may be rotatably mounted on the second stub shaft such that movement of the transfer member is transferred to the actuating member 108, the pivot member 82, the mounting plates and the leg members.

An important aspect of the realistic functioning of the invention is the nature and character of the stride of the leg members. While a free running steer of the type used in team roping competition typically may have a stride of approximately 200 centimeters (approximately 76 inches), it has been found that the stride of a steer is lengthened after the horns of the steer have been roped and the header team member pulls the steer to the left. It is believed that the stride of the steer is influenced by the stride of the horse of the header, which results in the relatively longer stride after the turn. Since the heeler team member must rope the hind legs of the steer after the steer has made the turn, the apparatus of the invention is directed to closely simulating the stride characteristic of the steer after the turn has been made. The stride length of the apparatus measured by the movement of the lower end of the leg members preferably falls in the range of approximately 250 centimeters (approximately 98 inches) to approximately 340 centimeters (approximately 135 inches). One highly preferred stride length is approximately 320 centimeters (approximately 126 inches) for highly accurate simulation of the stride of the steer. The speed at which the apparatus is pulled across the ground surface may be in a range of just greater than approximately 0 miles per hour (e.g., for the earliest stages of training) to approximately 22 miles per hour. One highly realistic speed for simulating the typical movement of the steer after the turn is approximately 16 miles per hour. It is thus highly desirable to adjust the rate at which the movement of the wheel is transferred to the leg members so that the length of the stride falls in this range when the apparatus is pulled around 16 miles per hour.

Since the support assembly is located forward of, rather than directly under, the steer assembly, a lower and more realistic profile of the steer assembly is achieved, and also a more stable apparatus is produced that is less likely to tip over while it is being pulled. Since a highly accurate pulling of the apparatus includes making a relatively sharp left turn with the apparatus similar to the left turn of the live steer after the header ropes the steer, the increased stability provided by the lower profile with the support assembly forward is highly useful.

In use, the apparatus of the invention may be attached to a vehicle or other pulling means by a pulling cord, and the apparatus is dragged on the skid members of the support assembly with the wheel being rotated by the ground moving underneath the apparatus. In more elementary stages of practice, the apparatus may be pulled in a substantially straight movement and at a relatively slow speed, and as the training progresses and the trainee becomes more skilled, the apparatus may be pulled at a relatively faster speed and the pulling of the apparatus may include a relatively sudden change in direction that simulates the left turn that the steer makes when the header team member ropes the head of the steer and pulls the steer to the left. The structure and arrangement of the apparatus of the invention permits relatively sharp and sudden turns to be made by the apparatus without the apparatus tipping over or becoming unstable and difficult to rope.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mechanical roping steer apparatus for practicing roping of a steer, the apparatus comprising:

a forward support assembly for resting on a ground surface, the support assembly having a front and a rear; and a rearward steer assembly located rearwardly of the support assembly and being mounted on the rear of the support assembly, the steer assembly comprising a leg assembly including a pair of leg members being pivotable with respect to the ground surface, and actuation means for pivoting the leg members when the support assembly is moved across the ground surface;

wherein the steer assembly comprises:

a forward frame portion removably mounted on the support assembly; and a rearward frame portion mounted on the forward frame portion;

wherein the forward frame portion includes an axle, and the actuation means includes a wheel rotatably mounted on the axle such that the wheel is rotated by the ground surface when the support assembly is moved along the ground surface.

2. The apparatus of claim 1 wherein the support assembly comprises:

a base portion having a forward end and a rearward end; and a pair of lateral skid portions for contacting the ground surface, the lateral skid portions extending laterally from the base portion.

3. The apparatus of claim 2 wherein the base portion comprises a base member extending from the forward end to the rearward end of the base portion.

4. The apparatus of claim 2 wherein each of the lateral skid portions comprises:

a skid member extending between the front and the rear of the support assembly, the skid member having a main portion being substantially linear and a forward portion extending forwardly and upwardly from the main portion; and at least one lateral member extending laterally from the base portion to the skid member, the lateral member extending downwardly from the base portion to the lateral skid portion to raise the base portion above the skid member with respect to the ground surface.

5. The apparatus of claim 1 wherein the rearward frame portion comprises:

a spine member extending rearwardly from the forward frame portion; and a body support member extending generally upwardly from the spine member.

6. The apparatus of claim 1 wherein each of the leg members has an upper portion and a lower portion with a lower end.

7. The apparatus of claim 6 additionally comprising a mounting structure for pivotally mounting the leg members on the rearward frame portion, the mounting structure comprising:

a mounting plate mounted on each of the leg members, each mounting plate being mounted on the upper portion of one of the leg members;

a pivot member mounted on the leg members and pivotally mounted on the rearward frame portion, the pivot member extending between the mounting plates on the leg members;

a yoke member mounted on a rearward frame portion of the steer assembly, the yoke member having a pair of sleeves with the pivot member extending through the sleeves of the yoke member; and at least one linking member extending between the leg members for coordinating pivot movement of the leg members.

8. The apparatus of claim 1 wherein the each of the leg members depend downwardly and have a lower end, and the leg assembly includes a foot extension member extending from the lower end of each of the leg members for contacting the ground surface during at least a portion of pivot movement of the leg members.

9. A mechanical roping steer apparatus for practicing roping of a steer, the apparatus comprising:

a forward support assembly for resting on a ground surface, the support assembly having a front and a rear; and a rearward steer assembly located rearwardly of the support assembly and being mounted on the rear of the support assembly, the steer assembly comprising a leg assembly including a pair of leg members being pivotable with respect to the ground surface, and actuation means for pivoting the leg members when the support assembly is moved across the ground surface;

wherein the steer assembly comprises:

a forward frame portion removably mounted on the support assembly; and a rearward frame portion mounted on the forward frame portion;

wherein each of the leg members has an upper portion and a lower portion with a lower end;

wherein the actuation means includes a wheel for being rotated by the ground surface as the support assembly is moved along the ground surface, and transferring means for transferring movement of the wheel to the leg assembly, the transferring means converting rotational movement of the wheel to pivot movement of the leg assembly with respect to the frame portions.

10. The apparatus of claim 9 wherein the transferring means comprises a pulley assembly including:

a driver pulley mounted on the axle of the forward frame portion for rotation with the wheel;

a pulley axle support mounted on one of the frame portions;

a pulley axle rotatably mounted on the pulley axle support;

a driven pulley mounted on one of the frame portions; and a belt rotatably connecting the driver pulley to the driven pulley.

11. The apparatus of claim 10 additionally comprising a reciprocating assembly for converting the rotational movement of the pulley axle to a generally reciprocating motion, the reciprocating assembly comprising:

an offset plate mounted on the pulley axle for rotating the offset plate upon rotation of the pulley axle, the offset plate extending radially outward from a longitudinal axis of the pulley axle;

a first stub shaft mounted on the offset plate such that a longitudinal axis of the first stub shaft is offset from the longitudinal axis of the pulley axle; and an elongate transfer member having a first end and a second end.

12. The apparatus of claim 11 wherein the transfer member includes:

a first end sleeve at the first end of the transfer member, the first end sleeve being rotatably mounted on the first stub shaft; and a second end sleeve at the second end of the transfer member.

13. The apparatus of claim 12 additionally comprising an actuating member mounted on the pivot member for movement with the pivot member, the actuating member being mounted on one of the linking members, and a second stub shaft being mounted on the actuating member, the second stub shaft having a longitudinal axis being spaced from a longitudinal axis of the pivot member, the second end sleeve of the transfer member being rotatably mounted on the second stub shaft such that movement of the transfer member is transferred to the actuating member and the pivot member.

14. The apparatus of claim 1 wherein each of the leg members has a lower end, and the actuation means causes the lower ends of the leg members to move a stride distance in the range of approximately 98 inches to approximately 135 inches.

* * * * *